US007962985B2

(12) United States Patent
Lee et al.

(10) Patent No.: US 7,962,985 B2
(45) Date of Patent: Jun. 21, 2011

(54) WASHING MACHINE AND METHOD FOR CONTROLLING THE SAME

(75) Inventors: Sang Bin Lee, Suwon-si (KR); Do Weon Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 688 days.

(21) Appl. No.: 12/000,330

(22) Filed: Dec. 11, 2007

(65) Prior Publication Data

US 2008/0216250 A1 Sep. 11, 2008

(30) Foreign Application Priority Data

Mar. 5, 2007 (KR) ..... 10-2007-0021613

(51) Int. Cl.
*D06F 35/00* (2006.01)

(52) U.S. Cl. ..... 8/158; 68/12.01; 68/12.02; 68/15

(58) Field of Classification Search ..... 8/158, 159; 68/12.01, 12.02, 15
See application file for complete search history.

(56) References Cited

U.S. PATENT DOCUMENTS

| | | | | |
|---|---|---|---|---|
| 6,295,411 | B1 * | 9/2001 | Fastman | 392/452 |
| 2005/0028295 | A1 * | 2/2005 | Jeon et al. | 8/158 |
| 2005/0041962 | A1 | 2/2005 | Moulder | |

FOREIGN PATENT DOCUMENTS

| | | | | |
|---|---|---|---|---|
| DE | 198 16 439 | A1 | | 7/1999 |
| DE | 10 2005 054 159 | A1 | | 5/2007 |
| EP | 1 865 100 | A1 | | 12/2007 |
| KR | 10-2005-0021063 | | | 3/2005 |
| KR | 634796 | B1 | * | 10/2006 |
| KR | 2007034901 | A | * | 3/2007 |
| WO | 03/027580 | A1 | | 4/2003 |

OTHER PUBLICATIONS

Machine Translation of Kim et al. KR 2007034901A, Mar. 2007.*
Machine Translation of Kim et al. KR 634796B1, Oct. 2006.*
European Search Report mailed Aug. 6, 2009 in European Patent Application 07123660.8.

* cited by examiner

*Primary Examiner* — Michael Barr
*Assistant Examiner* — David Cormier
(74) *Attorney, Agent, or Firm* — Staas & Halsey LLP

(57) ABSTRACT

Disclosed are a washing machine, in which substances stuck to the surface of a heater are washed off to minimize the generation of scale on the heater, and a method for controlling the same. The washing machine includes a tub; a heater installed in the tub for heating washing water; and a washing device for washing the heater. The washing device includes a spray nozzle for spraying the washing water to the heater, and a washing pump for supplying the washing water in the tub to the spray nozzle. The washing of the heater is performed in the first rinsing operation.

3 Claims, 5 Drawing Sheets

WASHING MACHINE AND METHOD FOR CONTROLLING THE SAME

CROSS-REFERENCE TO RELATED APPLICATIONS

This application claims the priority benefit of Korean Patent Application No. 2007-0021613, filed Mar. 5, 2007, in the Korean Intellectual Property Office, the disclosure of which is incorporated herein by reference.

BACKGROUND

1. Field

Embodiments relate to a washing machine and a method for controlling the same, and more particularly, to a washing machine, in which a heater for heating washing water is washable, and a method for controlling the same.

2. Description of the Related Art

Recently, washing machines have a function for heating washing water, as occasion demands, during a process for washing laundry so as to improve a washing effect and sterilize the laundry. For example, a washing machine, as disclosed in Korean Patent Laid-open Publication No. 2005-0021063, heats washing water using a heater installed in the lower portion of the inside of a tub.

However, in the above washing machine, a scale is deposited on the heater due to sticking of cations, such as magnesium or calcium, contained in the washing water to the outer surface of the heater when the heater is heated. It may be severe in the case that hard water is used as the washing water. The scale deposited on the outer surface of the heater prevents the heat transfer from the heater to the washing water, thus deteriorating a heating effect. Further, the scale may further cause the overheating and breakage of the heater.

Accordingly, in the washing machine disclosed in the Korean Patent Laid-open Publication No. 2005-0021063, a separate copper rod is installed on the upper portion of the heater so that cations, such as magnesium or calcium, can be stuck to the copper rod. Since the cations, such as magnesium or calcium, are stuck to the copper rod before the cations are stuck to the heater, it is possible to reduce the generation of scale on the heater.

The above washing machine can reduce the generation of scale on the heater, but the heater can still contact a magnesium or calcium component dissolving in the washing water. Thus, the washing machine cannot satisfactorily prevent the generation of scale on the heater.

SUMMARY

In accordance with one aspect, there is provided a washing machine, in which substances stuck to the outer surface of a heater are washed off so as to minimize the generation of scale on the heater, and a method for controlling the same.

In accordance with one aspect, there is provided a washing machine including a tub; a heater installed in the tub to heat washing water; and a washing device to wash the heater, wherein the washing device includes a spray nozzle to spray the washing water to the heater, and a washing pump to supply the washing water in the tub to the spray nozzle.

The washing machine may further include a drain pipe, connected to the tub, to drain the washing water in the tub; and a drain pump to discharge the washing water of the drain pipe to the outside, and the washing pump may supply the washing water of the drain pipe to the spray nozzle.

The heater may be installed in the lower portion of the inside of the tub, and the spray nozzle may be installed at the lower portion of the tub.

In accordance with another aspect, there is provided a washing machine including a tub; a heater installed in the tub to heat washing water; a drain pump to drain the washing water in the tub; and a washing device to spray the washing water discharged from the drain pump onto the heater, wherein the washing device includes a spray nozzle to spray the washing water to the heater, a washing pipe to guide the washing water discharged from the drain pump to the spray nozzle; and a flow path conversion valve to convert a flow path so as to supply the washing water discharged from the drain pump to the washing pipe or drain the washing water discharged from the drain pump to the outside.

In accordance with yet another aspect, there is provided a method for controlling a washing machine, in which washing water is sprayed to a heater installed in a tub so as to wash the heater, including determining whether a rinsing operation is carried out; and performing washing of the heater when the rinsing operation is carried out.

The washing water in the tub may be drained so that a water level in the tub reaches a level of the washing water, in which the heater is not soaked, before the washing of the heater is performed.

The washing of the heater may be performed using the residual washing water in the tub.

The rinsing operation may be carried out more than one time, and the washing of the heater may be performed in the first rinsing operation.

BRIEF DESCRIPTION OF THE DRAWINGS

These and/or other aspects, features, and advantages will become apparent and more readily appreciated from the following description of exemplary embodiments, taken in conjunction with the accompanying drawings of which.

DETAILED DESCRIPTION OF EMBODIMENTS

Figure 1:
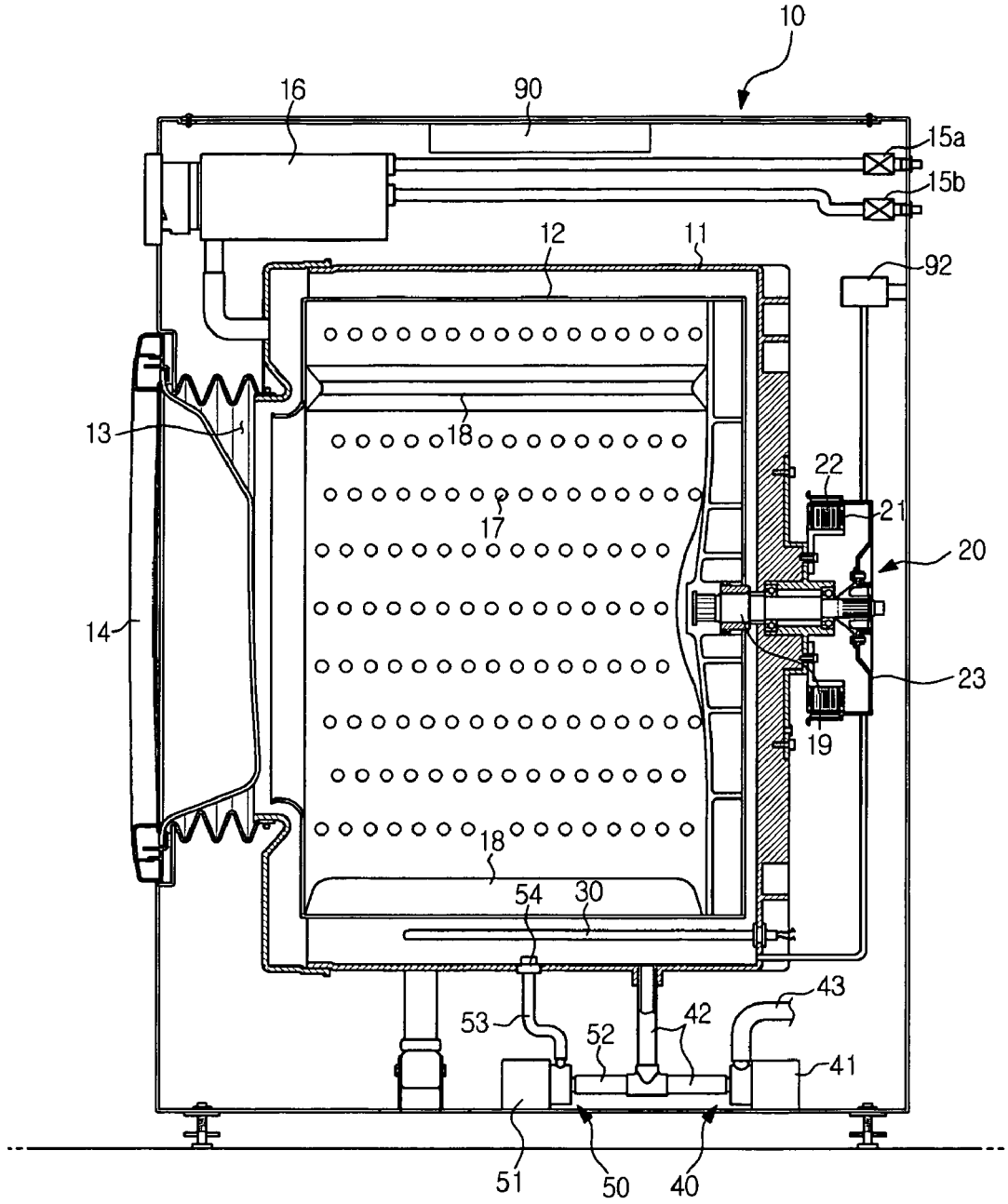
FIG. 1 is a sectional view of a washing machine in accordance with an exemplary embodiment.

Reference will now be made in detail to exemplary embodiments, examples of which are illustrated in the accompanying drawings, wherein like reference numerals refer to like elements throughout. Exemplary embodiments are described below by referring to the annexed drawings.

As shown in FIG. 1, a washing machine of an exemplary embodiment includes a tub 11, having a cylindrical structure, installed in a main body 10 for containing washing water, and a rotary drum 12 rotatably installed in the tub 11.

An opening 13, through which laundry is put into the rotary drum 12, is formed through the front surface of the main body 10, and a door 14, which can be opened and closed, is installed at the opening 13. Water supply valves 15*a* and 15*b* for controlling the supply of water, and a detergent supply device 16 for supplying a detergent to the inside of the tub 11 during the water supply process are installed above the tub 11.

The rotary drum 12 has a cylindrical structure provided with a plurality of through holes 17 formed through the circumferential surface thereof, and includes a plurality of lifters 18 formed on the inner surface thereof for lifting and dropping laundry. A rotary shaft 19 rotatably supporting the rotary drum 12 is connected to the rear surface of the rotary drum 12.

The rotary shaft 19 passes through the rear surface of the tub 11 and is extended backwardly, and a driving motor 20 for rotating the rotary shaft 19 is installed on the rear surface of the tub 11. Therefore, the driving motor 20 rotates the rotary drum 12. The driving motor 20 includes a stator 21 fixed to the rear surface of the tub 11, a rotor 22 rotatably disposed at the outside of the stator 21, and a support plate 23 having an outer circumferential surface connected to the rotor 22 and a central portion connected to the rotary shaft 19 so as to rotatably support the rotor 22.

A heater 30 for heating washing water is installed in the lower portion of the inside of the tub 11. The heater 30 heats the washing water contained in the tub 11 when a washing operation is operated, thus improving a washing effect and sterilizing laundry.

A drain device 40 for draining the washing water in the tub 11 and a washing device 50 for spraying washing water to the heater 30 in the tub 11 to wash the heater 30 are installed under the tub 11.

Figure 2:
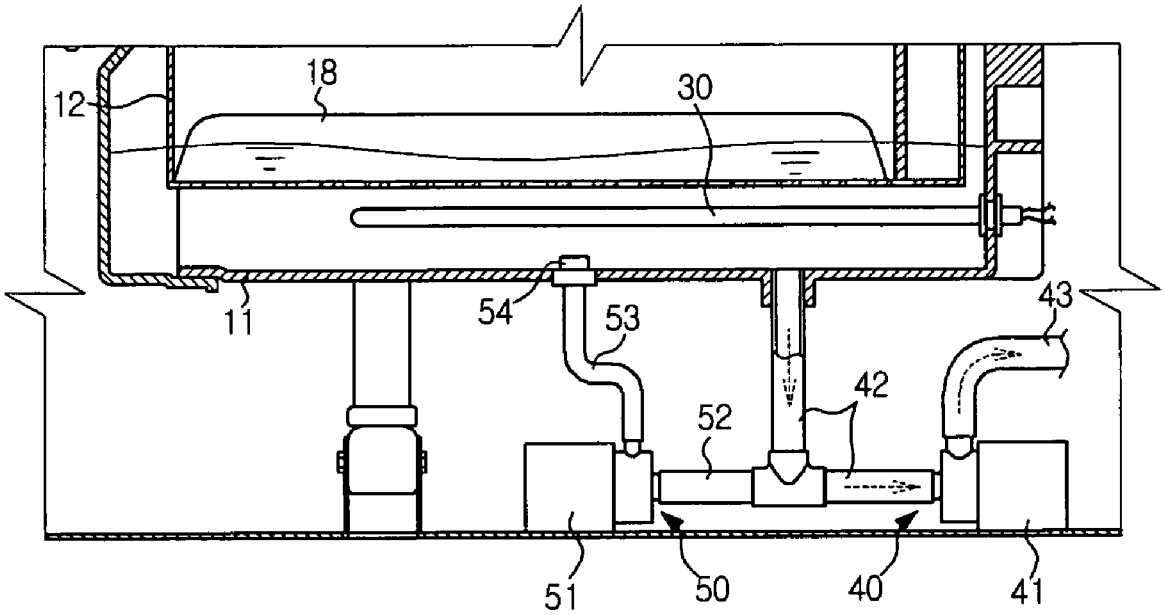
FIG. 2 is a detailed view of a drain device and a washing device of a washing machine in accordance with an exemplary embodiment, illustrating a draining operation.
Figure 3:
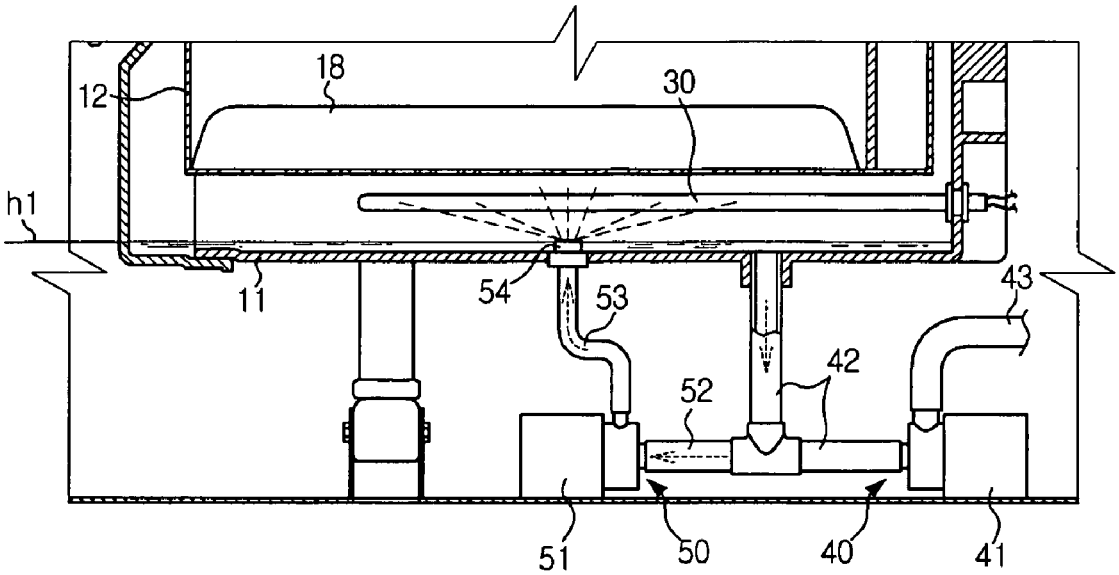
FIG. 3 is a detailed view of the drain device and the washing device of the washing machine, illustrating a heater washing operation.

The drain device 40 includes a drain pump 41, a first drain pipe 42 for connecting the lower portion of the tub 11 and an inlet of the drain pump 41, and a second drain pipe 43 for guiding the washing water discharged from the drain pump 41 to the outside of the main body 10. As shown in FIGS. 2 and 3, the drain pump 41 is operated, and thus forcibly discharges the washing water contained in the tub 11 to the outside of the main body 10.

The washing device 50 includes a washing pump 51, a spray nozzle 54 installed at the lower portion of the tub 11, a first washing pipe 52 branched off from the first drain pipe 42 and connected to an inlet of the washing pump 51, and a second washing pipe 53 for connecting an outlet of the washing pump 51 and the spray nozzle 54. As shown in FIG. 3, the washing pump 51 is operated and thus supplies the washing water of the first drain pipe 42 to the spray nozzle 54, and the spray nozzle 54 sprays the washing water to the heater 30, thereby washing substances stuck to the heater 30. When the heater 30 is washed as described above, substances, such as magnesium or calcium, stuck to the heater 30 are removed by the sprayed washing water, and the generation of scale on the heater 30 is minimized. Although FIG. 3 illustrates the washing device 50 including one spray nozzle 54, the washing device 50 is not limited thereto. That is, the washing device 50 may include a plurality of spray nozzles, which are spaced from each other in the lengthwise direction of the heater 30.

The above washing machine works in order of washing, rinsing, and dehydrating operations. In the washing operation, the rotary drum 12 is rotated under the condition that washing water and a detergent are supplied to the inside of the tub 11, so as to lift and drop laundry. In the rinsing operation, the washing water in the tub 11 is drained after the washing operation, fresh washing water is supplied to the inside of the tub 11, and the rotary drum 12 is rotated several times. During the rinsing operation, the above process is repeated several times and then the washing water in the tub 11 is finally drained. In the dehydrating operation, the rotary drum 12 is rotated at a high speed, thus removing the residual washing water of the laundry. At this time, the drain pump 41 is operated so as to drain the washing water simultaneously with the dehydrating of the laundry.

As shown in FIG. 1, the washing machine further includes a controller 90 for controlling the overall operation of the washing machine, and a water level sensor 92 for sensing a water level in the tub 11. The washing of the heater 30 is controlled by the controller 90 in the above-described rinsing operation. Hereinafter, a method for controlling the washing of the heater 30 during a rinsing operation will be described.

Figure 4:
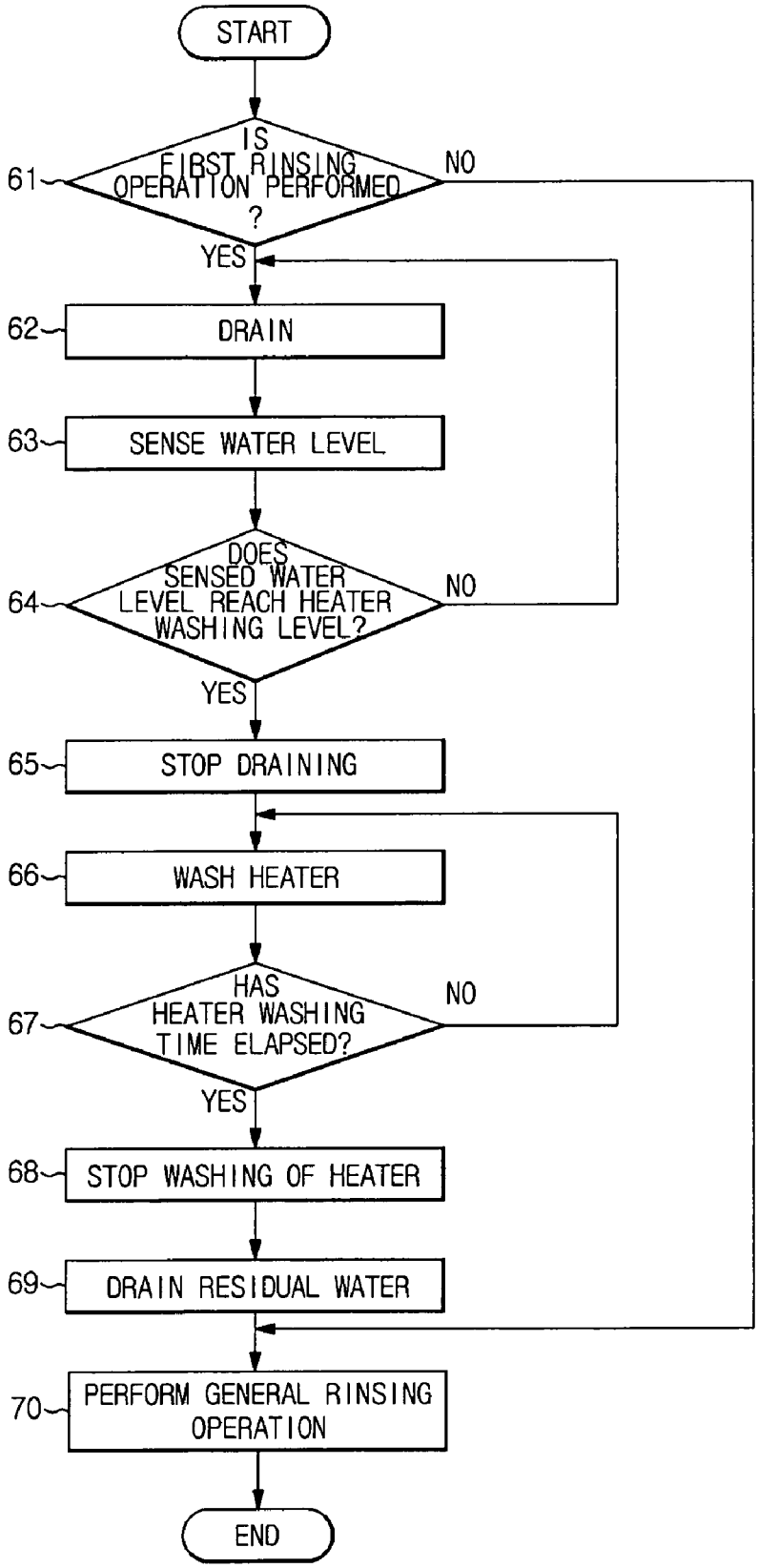
FIG. 4 is a flow chart illustrating a process for controlling the heater washing operation of the washing machine of an exemplary embodiment.

As shown in FIG. 4, in the rinsing operation, the controller first determines whether or not the rinsing operation is the first rinsing operation (61). When it is determined that the rinsing operation is the first rinsing operation, the drain pump 41 is operated so as to drain the tub 11 (62). While the tub 11 is drained, the water level sensor senses a water level in the tub 11 (63), and the controller determines whether or not the water level in the tub 11 reaches a heater washing level (h1) (64). Here, the heater washing level (h1) is a level at which the heater 30 is not soaked in the washing water so as to be a washable state and a designated amount of the washing water for washing the heater 30 remains in the lower portion of the inside of the tub 11, as shown in FIG. 3.

When it is determined that the water level in the tub 11 reaches the heater washing level (h1), the draining of the tub 11 is stopped so that the water level is maintained (65), and the washing pump 51 is operated to wash the heater 30 (66). Here, substances (magnesium, calcium, and so on) stuck to the outer surface of the heater 30 are washed off by the washing water sprayed from the spray nozzle 54.

Thereafter, while the washing of the heater 30 is performed, it is determined whether or not a predetermined heater washing time has elapsed (67). When it is determined that the predetermined heater washing time has elapsed, the operation of the washing pump 51 is stopped so that the washing of the heater 30 is stopped (68). Alternatively, when it is determined that the predetermined heater washing time has not elapsed, the washing pump 51 is continuously operated.

After the washing of the heater 30 is performed, the drain pump 41 is operated and thus the residual washing water in the tub 11 is drained (69), and a general rinsing operation is operated (70). Here, the general rinsing operation is an operation that laundry is rinsed by repeating the supplying of water and the draining of water without washing the heater 30. In the above step 61, when it is determined that the rinsing operation is not the first rinsing operation, the general rinsing operation is operated. Thereafter, the subsequent operation of the washing machine is carried out in the same manner as that of a general washing machine.

The reason why the washing of the heater 30 is carried out during the first rinsing operation is that although laundry is contaminated by the washing water sprayed during the washing of the heater 30, contaminants can be washed off by the subsequent general rinsing operation.

Figure 5:
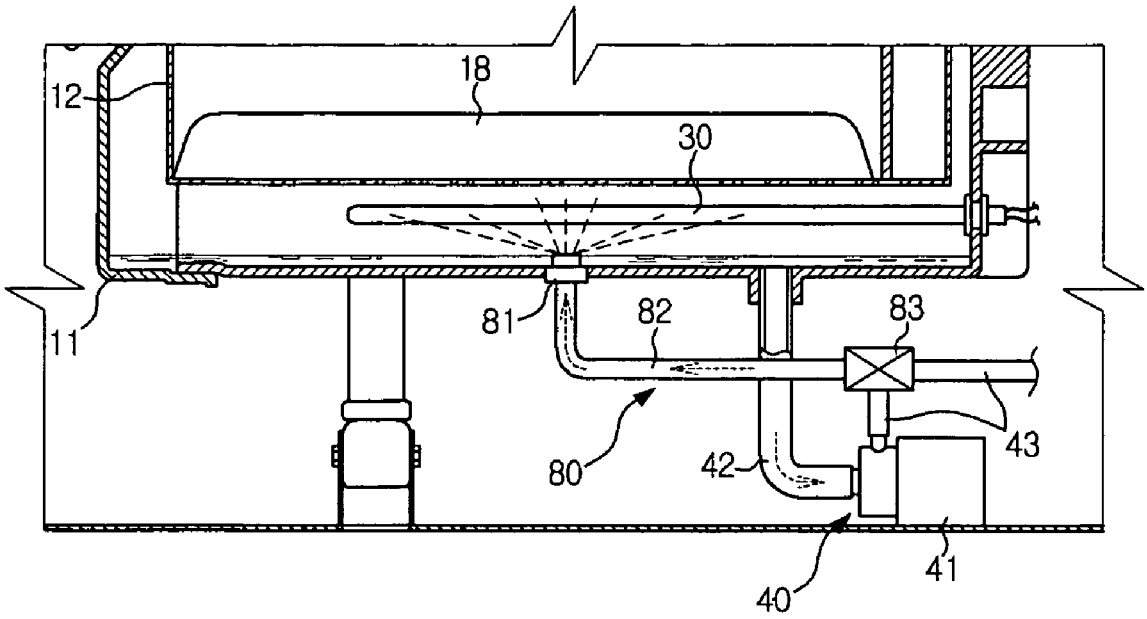
FIG. 5 is a detailed view of a drain device and a washing device of a washing machine in accordance with another exemplary embodiment.

FIG. 5 illustrates a drain device and a washing device of a washing machine in accordance with another exemplary embodiment. A washing device 80 of FIG. 5 includes a spray nozzle 81, a washing pipe 82 provided with one end connected to the spray nozzle 81 and the other end connected to the second drain pipe 43 at the outlet of the drain pump 41, and a flow path conversion valve 83 installed at a connection point of the washing pipe 82 and the second drain pipe 43 for converting a flow path. Differing from an earlier exemplary embodiment, this exemplary embodiment allows the draining of the tub 11 and the washing of the heater 30 to be carried out simultaneously using a single drain pump 41.

The flow path conversion valve 83 converts the flow path so that the washing water discharged by the operation of the single drain pump 41 is supplied to the washing pipe 82 or discharged to the outside through the second drain pipe 43. A conventional electrically-operated three way valve, which is controlled by the operation of the controller, is used as the flow path conversion valve 83. Accordingly, when the drain pump 41 is operated under the condition that the flow path conversion valve 83 of the washing device 80 is converted into a washing mode, the washing water is sprayed onto the heater 30 through the spray nozzle 81, thus washing the heater 30.

In order to drain the tub 11, the drain pump 41 is operated under the condition that the flow path conversion valve 83 is converted into a draining mode. Thereby, the washing water in the tub 11 is discharged to the outside of the main body 10 through the first drain pipe 42 and the second drain pipe 43.

As apparent from the above description, exemplary embodiments provide a washing machine, in which washing water in a tub is sprayed directly onto a heater by operating a washing pump or a drain pump so as to wash off substances stuck to the outer surface of the heater, and a method for controlling the same, thus minimizing the generation of scale on the heater.

Further, since the heater of the washing machine of an exemplary embodiment is washed in the first rinsing operation, although laundry is contaminated during a process for washing the heater, the washing machine of an exemplary embodiment allows the contaminants of the laundry to be washed off through a subsequent general rinsing operation.

Although a few exemplary embodiments have been shown and described, it would be appreciated by those skilled in the art that changes may be made in these exemplary embodiments, the scope of which is defined in the claims and their equivalents.

What is claimed is:

1. A method for controlling a washing machine, in which washing water is sprayed to a heater installed in a tub so as to wash the heater, comprising:

determining whether a rinsing operation is carried out;

draining the washing water from the tub to a level at which the heater is not soaked in the washing water, when the rinsing operation is carried out; and performing the washing of the heater after the washing water is drained from the tub to the level at which the heater is not soaked in the washing water.

2. The method according to claim 1, wherein the washing of the heater is performed using a residual washing water in the tub.

3. The method according to claim 1, wherein:

the rinsing operation is carried out more than one time; and the washing of the heater is performed only in the first rinsing operation.

* * * * *